United States Patent [19]

Mikulicz et al.

[11] 4,039,603

[45] Aug. 2, 1977

[54] VAPOR PRESSURE-ADJUSTED MOTOR FUEL ALKYLATE OF REDUCED FLUORIDE CONTENT

[75] Inventors: Michael Z. Mikulicz, Palatine; Vance P. Burton, Arlington Heights, both of Ill.

[73] Assignee: UOP Inc., Des Plaines, Ill.

[21] Appl. No.: 657,675

[22] Filed: Feb. 12, 1976

[51] Int. Cl.[2] ..... C07C 3/54

[52] U.S. Cl. ..... 260/683.42; 260/683.41; 260/683.48

[58] Field of Search ..... 260/683.48, 683.42, 260/683.41, 683.43; 208/17

[56] References Cited

U.S. PATENT DOCUMENTS

| | | | |
|---|---|---|---|
| 2,413,868 | 1/1947 | Frey | 260/683.42 |
| 2,890,995 | 6/1959 | Findlay | 208/17 |
| 3,004,089 | 10/1961 | Hutto | 260/683.48 |
| 3,066,175 | 11/1962 | Bauer et al. | 260/683.48 |
| 3,254,137 | 5/1966 | Hutto et al. | 260/683.41 |
| 3,660,520 | 5/1972 | Hemminger | 260/683.43 |

*Primary Examiner*—George J. Crasanakis
*Attorney, Agent, or Firm*—James R. Hoatson, jr.; Robert W. Erickson; William H. Page, II

[57] ABSTRACT

The reaction product effluent emanating from an isoparaffinic/olefinic, HF-alkylation reactor system, containing normal paraffins, motor fuel, alkylate, unreacted isoparaffins, hydrogen fluoride catalyst and organic fluoride compounds, is separated to recover a motor fuel alkylate product substantially free from fluoride compounds, and having a predetermined volatility, or vapor pressure. Two separation zones are employed to produce an alkylate containing hydrogen fluoride and a normal paraffin stream containing organic fluoride and hydrogen fluoride. Three treating zones afford the recovery of a fluoride-free motor fuel alkylate and a fluoride-free normal paraffin concentrate; a portion of the latter is blended with the former to adjust the volatility to the predetermined level.

8 Claims, 1 Drawing Figure

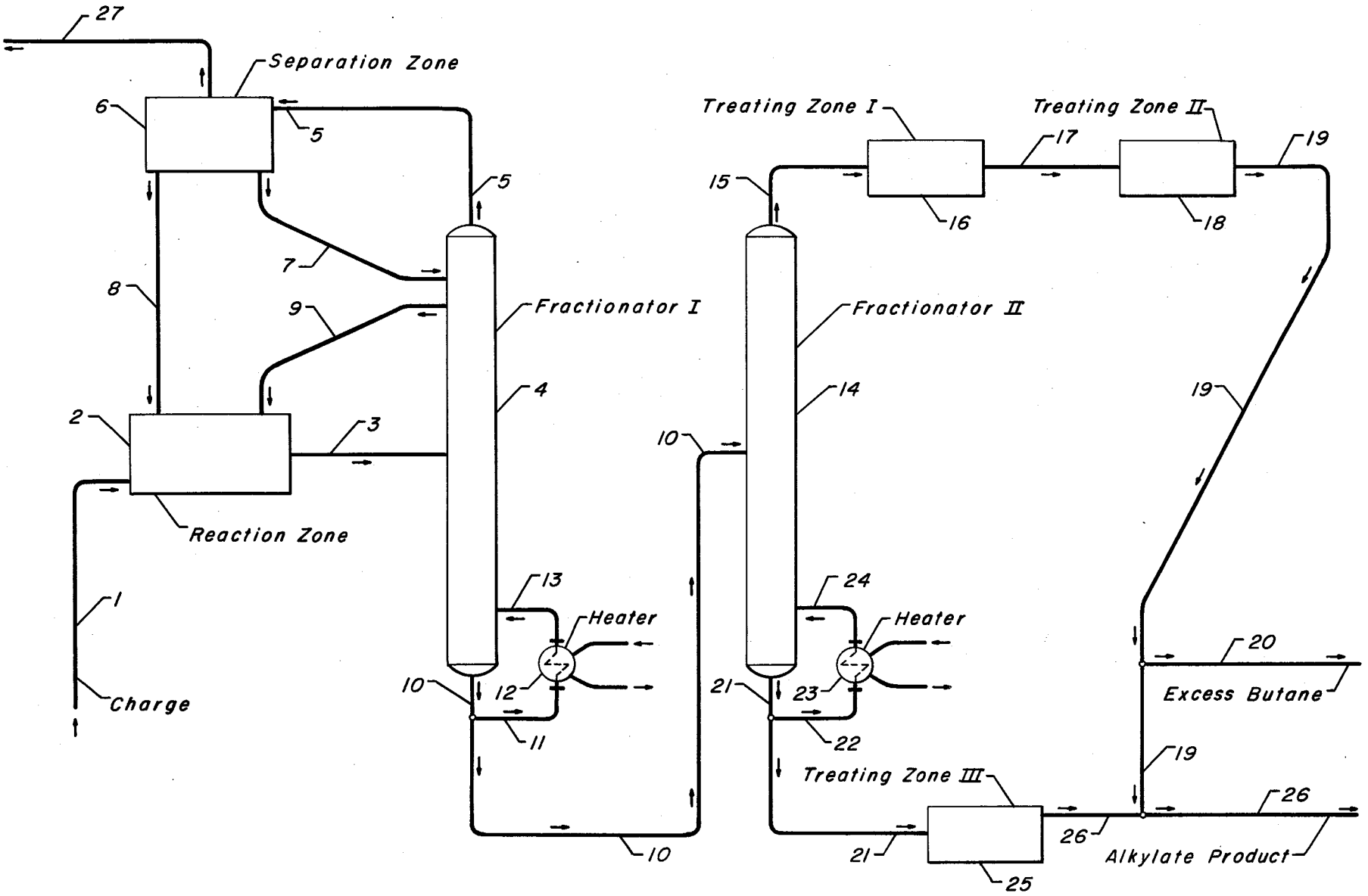
Separation Zone
Reaction Zone
Charge
Fractionator I
Fractionator II
Heater
Heater
Treating Zone I
Treating Zone II
Treating Zone III
Excess Butane
Alkylate Product

VAPOR PRESSURE-ADJUSTED MOTOR FUEL ALKYLATE OF REDUCED FLUORIDE CONTENT

APPLICABILITY OF INVENTION

The invention herein described is intended for utilization in the production of a normally liquid alkylate product via the reaction of an isoparaffin with an olefin, or olefin-acting compound. Although it may be used with any well known acid-catalyzed alkylation process, our invention is principally to be applied to those processes which are effected in contact with a hydrogen fluoride catalyst. More than about 35 years ago, the demand the high-octane fuels, possessing enhanced anti-knock properties, increased at a staggering rate. These improved fuels were required in voluminous quantities to satisfy the then-accelerating degree of consumption. Within the petroleum industry, various processes were developed which proved successful in alleviating the intertwined problems attendant supply, quality and demand. Among the first of such processes was the acid-catalyzed alkylation of an isoparaffin with an olefin, both generally normally vaporous, to produce a higher molecular weight, normally liquid isoparaffin. Since isoparaffins, in contrast to normal paraffins, possess significantly higher octane ratings and blending values, and thus greatly improve anti-knock properties, processes capable of efficiently effecting such a reaction have gained, and continue to gain wide acceptance within the petroleum industry.

For many economic and technical reasons, well known to those possessing the requisite skill in the appropriate art, the alkylation process catalyzed through the use of hydrogen fluoride predominates. HF alkylation of an isoparaffin with an olefin has, since the advent thereof, experienced a multitude of changes and improvements with respect to unit design and operating techniques. Our inventive concept, as hereinafter described in greater detail, encompasses a method for the separation of the alkylation reaction product effluent to recover a substantially fluoride-free motor fuel alkylate having a predetermined volatility, or vapor pressure. Therefore, the particularly selected technique for operating the reaction zone, and its attendant vessels, forms no essential part of the present invention.

Hydrogen fluoride is a particularly dangerous compound in virtually any concentration, whether in liquid, or vapor form. The harmful effects incurred by both animal and plant life have resulted in strenuous efforts to prevent the release of hydrogen fluoride, and its precursors, into the atmosphere. Organic fluorides, formed while effecting the HF-catalyzed alkylation reactions, are also hazardous in view of the likelihood of their conversion to hydrogen fluoride. It is essential, therefore, that the fluoride content of motor fuel, and especially hydrogen fluoride-produced alkylate, be rigorously controlled.

For the proper functioning of a motor fuel, it is essential that its volatility (vapor pressure) be maintained with certain limitations which are seasonably determined. Vapor pressure components must be withdrawn, or added to motor fuel alkylate in order to adjust the vapor pressure to the then-existing specification. The method of our invention provides a novel manner of effectively and efficiently attaining both the predetermined vapor pressure and the fluoride content limitation of motor fuel alkylate.

OBJECTS AND EMBODIMENTS

A principal object of our invention is to afford a method for separating the reaction product effluent from a hydrogen fluoride alkylation system. A corollary objective is to provide a technique for effecting the defluoridation of alkylation reaction products emanating from processes utilizing hydrofluoric acid catalyst.

A specific object is directed toward the recovery of a motor fuel alkylate having a predetermined vapor pressure and being substantially free from fluoride compounds.

Therefore, in a process wherein an isoparaffinic/olefinic hydrocarbon feed stream, containing normal paraffins is reacted in an alkylation reaction zone, in admixture with a hydrogen fluoride catalyst, resulting in a reaction zone effluent containing (1) motor fuel alkylate, (2) unreacted isoparaffinic hydrocarbons, (3) hydrogen fluoride catalyst, and (4) organic fluoride compounds, one embodiment of our invention is directed toward the method of recovering said motor fuel alkylate having a predetermined vapor pressure, and substantially free from fluoride compounds, which method comprises the integrated steps of: (a) separating said reaction zone effluent, in a first fractionation zone, at separation conditions selected to decompose organic fluoride, and to provide (i) an isoparaffin concentrate containing hydrogen fluoride and, (ii) a first motor fuel alkylate stream of reduced organic fluoride content, and containing hydrogen fluoride and normal paraffins; (b) separating said first alkylate stream, in a second fractionation zone, atseparation conditions selected to decompose additional organic fluorides, and to provide (i) a normal paraffin concentrate containing organic fluorides and hydrogen fluoride, and, (ii) a second motor fuel alkylate stream substantially free from organic fluorides and containing hydrogen fluoride; (c) chemically treating said normal paraffin concentrate, in a first treating zone, at conditions to decompose organic fluorides; (d) further chemically treating the resulting substantially organic fluoride-free normal paraffin concentrate, in a second treating zone, at conditions to decompose hydrogen fluoride and to produce a substantially fluoride-free normal paraffin concentrate; (e) chemically treating said second alkylate stream, in a third treating zone, at conditions selected to decompose hydrogen fluoride and to produce a third motor fuel alkylate stream substantially fluoride-free; and, (f) admixing at least a portion of said fluoride-free normal paraffin concentrate with said third alkylate stream to adjust its vapor pressure to the predetermined level.

These, as well as other objects and embodiments, will becomes evident from the following more detailed description of the recovery method encompassed by our inventive concept. In one such other embodiment, the first treating zone has disposed therein a bed of particulate refractory metal oxide, while said second and third treating zones have disposed therein an alkali metal hydroxide.

PRIOR ART

Candor compels recognition and acknowledgement of the fact that the prior art is replete with a wide variety of publications, inclusive of issued patents, directed toward the acid-catalyzed alkylation of an isoparaffin with an olefin. This is particularly true with respect to hydrogen fluoride alkylation which traces its development over an approximate 35-year period. Any attempt herein to exhaustively delineate the hydrogen fluoride alkylation art would constitute an exercise in futility. However, it is believed that a brief description of several innovations, for the purpose of illustrating the areas to which the present invention is applicable, is warranted.

U.S. Pat. No. 3,560,587 (Cl. 260–683.48) describes the hydrogen fluoride alkylation of an isoparaffin/olefin mixture in a system which incorporates a reaction cooler, reaction soaker and a hydrogen fluoride acid settler. The greater proportion of the hydrogen fluoride phase, separated within the settler, is recycled to the cooled reaction zone for further contact with the reactant mixture.

U.S. Pat. No. 3,686,354 (Cl. 260–683.43) is fairly illustrative of a complete hydrogen fluoride alkylation system including reaction vessels, reaction effluent separation for acid recovery and product separation for the recovery of normally liquid alkylate product. In this particular system, the alkylate product is separated into a relatively high-octane fraction and a relatively low octane fraction, the latter being further treated with additional isoparaffin and hydrogen fluoride catalyst.

U.S. Pat. No. 3,249,650 (Cl. 260–683.48) offers another fairly complete illustration of a hydrogen fluoride alkylation process in which a portion of the separated hydrogen fluoride is regenerated to recover polymer products which are then utilized to supply a portion of the required heat energy within the process.

U.S. Pat. No. 3,929,926 (Cl. 260–683.48) involves controls of the HF alkylation reaction zone temperature in response to the octane rating of the motor fuel alkylate product. Illustrated, however, is a complete HF alkylation system including product separation and recovery.

In these exemplary processes, asignificant amount of organic fluoride by-products are formed as a result, it is believed, of the fluoridation of olefinic hydrocarbons. Also, in such processes, seasonal variations in the specification of vapor pressure necessitate control of the quantity of normal butane remaining in the motor fuel alkylate product. Commonly, butanes are removed from the alkylate product in an amount sufficient to adjust the vapor pressure to the desired level. Organic fluorides which, due to the proximity of their boiling points to that of butane, accompany the butane remaining within the alkylate product, and ultimately are discharged into the atmosphere. A review of the applicable prior art, as above exemplified, reveals that the same is totally unaware of the separation method of the present invention which assures that the motor fuel alkylate will meet both fluoride content and vapor pressure specifications when it is withdrawn from the processing unit without further treatment or refining.

SUMMARY OF INVENTION

As hereinabove set forth, the product recovery method encompassed by our inventive concept is intended to be integrated into a process for alkylating an isoparaffin-/olefin reactant stream. Although particularly applicable for utilization in the alkylation of isobutane with a butylene-containing olefinic stream, the process is also acceptable for use with other isoparaffinic and olefinic feedstocks. Suitable isoparaffinic hydrocarbons are those having from about four to about seven carbon atoms per molecule, including isobutane, isopentane, neopentane, one or more of the isohenanes and various branched-chain heptanes. Similarly, the olefinic reactant contains from about three to about seven carbon atoms per molecule, and includes propylene, 1-butene, 2-butene, isobutylene, the isomeric amylenes, hexenes, heptenes and mixtures thereof.

The alkylation reaction mixture comprises hydrogen fluoride catalyst, and isoparaffins and olefinic hydrocarbons; since both internal and external sources of the olefinic hydrocarbons contain significant quantities of the corresponding paraffins, these will appear in the alkylation reaction mixture. Hydrogen fluoride is utilized in an amount generally sufficient to provide a catalyst/hydrocarbon volume ratio, within the reaction zone, of from about 0.5 to about 3.0. As a general practice, commercial anhydrous hydrogen fluoride will be charged to the alkylation system as fresh catalyst. It is possible to use hydrogen fluoride containing as much as about 10.0% water; however, excessive dilution with water is undesirable since it tends to reduce the alkylation activity of the catalyst and introduces severe corrosion problems into the system. In order to reduce the tendency of the olefinic portion of the hydrocarbon feedstock to undergo polymerization prior to alkylation, the molar proportion of isoparaffin to olefinic hydrocarbon within the reaction zone is maintained at a value greater than about 1.0:1.0, up to about 20.0:1.0, and preferably from about 3.0:1.0 to about 15.0:1.0.

Alkylation reaction conditions include temperatures in the range of about 0° F. (−17.8° C.) to about 200° F. (93° C.) and preferably from about 30° F. (−1.1° C) to about 110° F. (43° C.). In view of the fact that alkylation reactions are highly exothermic, suitable means for removing heat from the reaction zone is generally provided. Alkylation pressures are sufficiently high to maintain the hydrocarbons and hydrogen fluoride catalyst in substantially liquid phase; that is, from about 15.0 psi. (1.05 kg/sq.cm.) to about 600 psi. (42.18 kg/sq.cm.). Contact time in the alkylation reactor vessel is most conveniently expressed in terms of a space-time relationship which is defined as the volume of catalyst within the reactor or contacting zone divided by the volume rate per minute of hydrocarbon reactants charged to the zone. Generally, the space-time relationship will be less than about 5 minutes and preferably less than about 2 minutes.

The effluent from the alkylation reactor vessel is introduced into a separation zone generally comprising a two-vessel stacked system. The mixture is introduced into the lower vessel whih serves as a vertical mixer, or soaking zone. The mixer is sized and designed to provide an average residence time of the mixture within the range of about 60 seconds to about 1200 seconds, depending upon the composition of the mixture charged thereto. Following the desired residence time, the effluent is introduced into the upper vessel which serves as a settler to provide a hydrocarbon stream free from the major portion of hydrogen fluoride, and settled hydrogen fluoride which is substantially free from the major porportion of hydrocarbons. In a relatively recent technique, at least a portion of the effluent is emulsified and recycled to the alkylation reactor vessel. Settled hydrogen fluoride is recycled to the reactor vessel in admixture with regenerated hydrogen fluoride obtained as hereinafter set forth. The effluent generally contains relatively minor proportion of polymer products and other foreign matter formed during the alkylation reaction. These polymer products appear in the hydrogen fluoride phase removed from the lower portion of the acid settler. In order to prevent the build-up of polymer products within the reaction system, a relatively minor proportion of the settled hydrogen fluoride acid phase, containing the polymer products, is introduced into an acid regenerator. Recovered hydrogen fluoride is recycled to the alkylation reactor vessel in admixture with the settled hydrogen flouride.

The foregoing description of a portion of a typical, present-day HF alkylation system, is not to be construed as essential to, or limiting upon the recovery method of the present invention. As hereinafter indicated, in the description of the accompanying drawing, the major vessels thus far described — e.g. the reactor vessel, the combination mixer-settler and the acid regenerator — are considered the reaction zone. Our invention is principally concerned with the recovery of the motor fuel alkylate contained within the hydrocarbon phase which is separated as an overhead stream in the settler vessel. For the purposes of illustration, it will be presumed that the above-described process has been utilized and the alkylation of the isobutane with a propylene/butylene mixture. Therefore, the hydrocarbon phase separated in the settler, which is introduced into an isostripper fractionating column, will contain motor fuel alkylate, hydrogen fluoride, organic (alkyl) fluorides, butane, isobutane and propane. The isostripper fractionating column is herein referred to in the appended claims as the first separation zone. The principal function of the isostripper is to provide an overhead stream containing propane, isobutane and the major proportion of hydrogen fluoride catalyst. However, in accordance with the present recovery method, the separating conditions with the isostripper are such that the organic fluorides are decomposed. Therefore, the bottoms material withdrawn from the first separation zone constitutes a motor fuel alkylate stream of reduced organic fluoride concentration and containing hydrogen fluoride and normal butane.

Propane, unreacted isobutane and hydrogen fluoride removed in the overhead stream from the isostripper, are introduced into a settling zone from which the hydrogen fluoride is recycled to the reaction zone. The hydrocarbon phase from this settler is introduced into a depropanizing column with isobutane being removed as a bottoms fraction and recycled in part to the reaction zone and in part to the acid regenerator for the purpose of stripping hydrogen fluoride from the polymer products which are removed as a bottoms stream. A principally vaporous phase, predominately propane, containing a minor quantity of hydrogen fluoride, is introduced into a stripping column. The hydrogen fluoride is removed as an overhead fraction and introduced into the isostripper settler for ultimate return to the reaction zone. Propane is normally removed from the bottom of the HF stripper and sent to storage. This propane-rich product stream is generally subjected to both alumina treating and potassium hydroxide treating to remove trace quantities of hydrogen fluoride. In the accompanying drawing, the isostripper overhead settler, the depropanizing column and the HF stripper are referred to as the "separation zone".

Essentially, our recovery method utilizes two fractionators, or distillation columns, and three chemical treating zones. The first fractionator constitutes the isostripping column described above, and functions to decompose a portion of the alkyl fluorides introduced with the isostripper feed stream. Since these compounds characteristically boil at temperatures proximate both to normal butane and the motor fuel alkylate, the former, when utilized for vapor pressure control, contributes a considerable proportion of the fluoride content of the recovered motor fuel alkylate. Alkyl fluorides are decomposable at temperatures in the range of about 375° F. (191° C.) to about 475° F. (246° C.), and the isostripper functions with a reboiler section temperature in this range. The bottoms alkylate stream, reduced in organic fluoride content, is introduced into the second fractionating column wherein additional organic fluorides are decomposed and a second alkylate stream, containing hydrogen fluoride, is recovered. A normal butane concentrate, containing the remaining organic fluorides and hydrogen fluoride, is withdrawn as an overhead stream and introduced into the first chemical treating zone. In contact with a bed of particulate refractory metal oxide, having both hydrogenation and dehydrogenation activity, the remaining organic fluorides are virtually completely decomposed. The normal butane concentrate and hydrogen fluoride pass into the second chemical treating zone, containing an alkali metal hydroxide, to effect the removal of the hydrogen fluoride. The motor fuel alkylate, withdrawn as the bottoms stream from the second fractionation zone, is chemically treated within the third treating zone, in contact with an alkali metal hydroxide, for the removal of hydrogen fluoride. Sufficient normal butane is blended therewith to attain the predetermined vapor pressure, and the resulting motor fuel alkylate will contain less than about 10.0 ppm. (by weight) of fluorides, calculated as an elemental fluorine.

In the prior art alkylation processes, the recovered butane stream can contain up to about 600 ppm. of organic fluorides. This relatively large quantity of fluoride compounds contributes to the fluoride concentration of the alkylate product to the extent that the same can contain from about 25.0 to about 350 ppm. by weight thereof. Since it is desirable to recover a low-fluoride motor fuel alkylate having a predetermined vapor pressure, our method of recovery affords an eminently useful technique by which to achieve this end. Our method utilizes well-known principles of thermal decomposition of organic fluorides, the defluoridating capability of refractory metal oxides and the efficacy of alkali metal hydroxides to effect the removal of hydrogen fluoride. This technique is accomplished in a unique and utilitarian combination.

Fractionating, or distillation columns suitable for use in the present recovery method may be of any well-known design, especially those which are commonly employed in alkylation systems. These fractionating columns provide for withdrawal of both an overhead stream and a bottoms stream, and for the external reboiling of a portion of the bottoms material for the purpose of supplying heat to the column. With respect to the external reboiler heater, it may take the form of a heat-exchanger wherein the heating medium is high-pressure steam, hot oil, etc. Preferably, the external reboiler heater will take the form of a direct-fired heater. Temperatures encountered in the reboiler heaters utilizing a fluid heating medium are often inadequate for the decomposition of the organic fluorides. In order to assure that thermal decomposition of the organic fluorides is effected, it is preferred that the heat-input to the column be provided by the direct-fired reboiler heater. The source of heat is air which is heated by open flames with the result that the tube wall temperatures within the heater are significantly higher than those existing within a heater whose heat source is some other material.

Operating conditions within the first fractionation zone will include a pressure in the range of 125 psig. (8.79 kg/cm²) to about 350 psig. (24.61 kg/cm²), a bottom temperature of about 375°F. (191°C.) to about 475° F. (246° C.) and a top temperature of from about 100° F. (37.8° C.) to about 150° F. (66.0° C.). Under these conditions, the bottoms stream will be substantially free from isobutane, being a motor fuel alkylate stream of reduced organic fluoride content, and containing hydrogen fluoride and normal butane. This motor fuel alkylate stream is introduced into the second fractionating column which generally functions at conditions including a bottoms temperature of about 375° F. (191° C.) to about 475° F. (246° C.), a top temperature of about 90° F. to about 140° F. (32.2° C. to about 60.0° C.) and a pressure of about 120 psig. (8.44 kg/cm²) to about 170 psig. (11.95 kg/cm²). Under these conditions, the motor fuel alkylate withdrawn as the bottoms fraction will be substantially free from the normal butane an organic fluoride, but will contain hydrogen fluoride. The overhead normal butane concentrate will contain the remaining organic fluorides and hydrogen fluoride. The motor fuel alkylate stream from the second fractionating column is relatively free from organic fluorides due to the relative ease of thermally decomposing those organic fluorides which boil proximate to the boiling point range of the alkylate products.

The overhead fraction from the second fractionating column is introduced into a first chemical treating zone at a temperature in the range of about 380° F. (193° C.) to about 480° F. (249° C.), in order to complete the decomposition of the organic fluorides. This treating zone utilizes a solid particulate refractory metal oxide as the decomposition agent. The metal oxide may be naturally-occurring, or synthetically-prepared, but should be active for hydrogenation and dehydrogenation reactions. Suitable metal oxides include bauxite, alumina and alumina in combination with one or more other metal oxides such as silica, zirconia, etc.

The butane concentrate, containing hydrogen fluoride, emanating from the first treating zone, is introduced into the second chemical treating zone to effect substantially complete decomposition and removal of hydrogen fluoride. Alkali metal hydroxides constitute suitable agents, with potassium and/or sodium hydroxide being particularly preferred. The chemical treatment is generally effected in liquid phase, with the alkali metal hydroxide being disposed as a solid, particulate bed.

The hydrogen fluoride-containing motor fuel alkylate from the second fractionation column is introduced into a third chemical treating zone in order to effect the decomposition and removal of the remaining hydrogen fluoride. Suitable chemical treating agents include the alkali metal hydroxides, particularly potassium and/or sodium hydroxide, and are employed as aqueous solutions. Contact between the alkali metal hydroxide solution and the hydrogen fluoride dissolved within the motor fuel alkylate results in the formation of alkali metal fluorides, particularly insoluble in the alkylate product. The normally liquid alkylate product, withdrawn from the third treating zone, will contain less than about 10.0 ppm. by weight of fluorides. The normal butane concentrate withdrawn from the second treating zone is also substantially free from fluorides. This "vapor pressure component" stream is blended with the substantially fluoride-free motor fuel alkylate stream to provide a final product having the predetermined vapor pressure. Where an excess of the vapor pressure component is available, it is readily withdrawn as a separate product stream.

BRIEF DESCRIPTION OF DRAWING

In further describing our invention, reference will be made to the accompanying drawing which is presented for the sole purpose of illustration and not with the intent of limiting our invention beyond the scope and spirit of the appended claims. The drawing is presented as a simplified schematic flow diagram in which details such as pumps, instrumentation and other controls, quench systems, heat-exchange and heat-recovery circuits, valving, start-up lines and similar hardware have been eliminated as non-essential to an understanding of the techniques involved. The use of such miscellaneous appurtenances, to modify the process as illustrated, will be evident to those possessing the requisite skill in the art of petroleum refining technology.

In the drawing, the alkylation reactor, the combined mixer/settler and the acid regenerator of a typical HF alkylation system are considered as being part of reaction zone 2, while the isotripper settler, the depropanizing column and the hydrogen fluoride stripping column are included in separation zone 6.

DETAILED DESCRIPTION OF DRAWING

With reference now to the accompanying drawing, the same will be described in conjunction with a commercially-scaled HF alkylation system designed to produce a motor fuel alkylate by reacting isobutane with a butylene/propylene mixture. The total hydrocarbon charge is introduced by way of line 1, in the amount of 12,867 Bbl/day (85.23 M³/hr.), into reaction zone 2. In reaction zone 2, the hydrocarbon charge stock contacts a hydrogen fluoride catalyst comprising about 90.0% by weight hydrogen fluoride, 8.5% by weight dissolved organic matter and 1.5% by weight of water, at an acid/hydrocarbon volumetric ratio of about 1.5:1.0. On a lb-moles/hr. basis, the hydrocarbon charge stock has the following composition: 362.0 lb-moles/hr. (164.2 kg-moles/hr.) of propylene, 181.3 lb-moles/hr. (82.3 kg-moles/hr.) or propane, 395.4 lb-moles/hr. (179.4 kg-moles/hr.) of butylene, 820.8 lb-moles/hr. (372.3 kg-moles/hr.) of isobutane, 130.7 lb-moles/hr. (59.3 kg-moles/hr.) of normal butane, 25.8 lb-moles/hr. (11.7 kg-moles/hr.) of mixed pentenes, and 50.5 lb-moles/hr. (22.9 kg-moles/hr.) of isopentane.

The effluent from reaction zone 2, in the amount of about 10,825.14 lb-moles/hr. (4,920.52 kg-moles/hr.), is introduced via line 3 into the first fractionator 4. In this illustration, fractionator 4 functions at a pressure of 150 psig. (10.55 kg/sq.cm.), a bottoms temperature of about 380° F. (193° C.) and a top temperature of about 125° F. (51.8° C.). An overhead stream, principally comprising propane, isobutane and hydrogen fluoride, is withdrawn through line 5 and introduced thereby into separation zone 6. Reflux to fractinator 4 is supplied by 420.44 lb-moles/hr. (191.11 kg-moles/hr.) of a concentrated stream in line 7. A propane concentrate is recovered as a product through line 27 in the amount of 203.69 lb-moles/hr. (92.59 kg-moles/hr.). The remainder of the overhead stream is recycled to reaction zone 2 through line 8 in the amount of 638.21 lb-moles/hr. (290.10 kg-moles/hr.). An isobutane-rich side-cut stream, in the amount of 9,002.18 lb-moles/hr. (4,091.90 kg-moles/hr.) is recovered from line 9 and recycled to reaction zone 2.

A motor fuel alkylate stream is withdrawn from fractionator 4 through line 10 in the amount of 2,154.65 lb-moles/hr. (979.39 kg-moles/hr.). Of this quantity, 1,173.59 lb-moles/hr. (533.45 kg-moles/hr.) are diverted through line 11 into external reboiler heater 12, partially vaporized therein and returned to the reboiler section by way of line 12. As previously stated, heater 12 is preferably a direct-fired heater. The remaining 981.06 lb-moles/hr. (445.94 kg-moles/hr.), containing about 620 ppm. of total fluorides, continues through line 10 into second fractionation zone 14. The latter functions at a pressure of about 140 psig. (9.84 kg/sq. cm.), a bottoms temperature of about 375° F. (190.8° C.) and a top temperature of about 120° F. (49° C). An overhead stream, containing 14.14 lb-moles/hr. (6.43 kg-moles/hr.) of isobutane, 137.94 lb-moles/hr. (62.7 kg-moles/hr.) of normal butane, hydrogen fluoride and a lesser amount of organic fluorides than in the feed stream, is withdrawn via line 15. Motor fuel alkylate, in an amount of about 1,823.76 lb-moles/hr. (828.98 kg-moles/hr.), containing about 4 ppm. of organic fluorides and about 15 ppm. of hydrogen fluoride, is withdrawn via line 21. About 994.78 lb-moles/hr. (452.17 kg-moles/hr.) are diverted through line 22 into external reboiler heater 23. The partially vaporized material is reintroduced into the reboiler section through line 24. The remaining 828.98 lb-moles/hr. (376.81 kg-moles/hr.) continue through line 21, being introduced thereby into the third treating zone 25.

The overhead stream in line 15 is introduced into first treating zone 16, and therein contacts a bed of particulate activated alumina at a temperature of about 390° F. (199° C.) and a gas hourly space velocity of about 20.0. Substantially complete removal or organic fluorides is effected in this vapor phase zone. The defluoridated butane concentrate, contaminated principally by hydrogen fluoride, passes through line 17 into second treating zone 18. The latter contains a bed of particulate potassium hydroxide, and the decomposition and removal of essentially all the hydrogen fluoride is effected at conditions of temperature and pressure which maintain the operation in liquid phase. Contact is made at a liquid hourly space velocity of about 1.5, and the treated concentrate in line 19 contains about one ppm. of fluoride.

The motor fuel alkylate introduced into third treating zone 25 contains about 19 ppm. of total fluorides, and contacts liquid aqueous potassium hydroxide (about five times the stoichiometric requirement) at conditions which remove essentially all the hydrogen fluoride. The non-vapor pressure-adjusted motor fuel alkylate, containing about 4 ppm. of fluorides, is recovered in line 26. Of the 152.08 lb-moles/hr. (69.13 kg-moles/hr.) of defluoridated butanes in line 19, 60.61 moles/hr. (27.55 kg-moles/hr.) are recovered in line 20 as a product stream, the remaining portion continuing through line 19 to be admixed with the defluoridated motor fuel alkylate in line 26. The final alkylate product of 920.45 lb-moles/hr. (418.39 kg-moles/hr.), has a vapor pressure of about 8.2, and a fluoride content of about 5.0 ppm.

The foregoing clearly illustrates the method of effecting the present invention and the benefits afforded through the utilization thereof.

We claim as our invention:

1. In a process wherein an isoparaffin and olefin hydrocarbon feed stream, containing normal paraffins, is reacted in an alkylation reaction zone, in admixture with a hydrogen fluoride catalyst, resulting in a reaction zone effluent containing (1) motor fuel alkylate, (2) unreacted isopraffin, propane and normal butane, (3) hydrogen fluoride catalyst, and (4) organic fluoride compounds, the method of recovering said motor fuel alkylate having a predetermined vapor pressure, and substantially free from said fluoride compounds and said catalyst which comprises the integrated steps of:

a. separating said alkylate, unreacted isoparaffin, propane, normal butane, hydrogen fluoride and organic fluoride compounds in a first fractionation zone, at a temperature of about 100° F to about 475° F and a pressure of about 125 psig to about 350 psig. to decompose organic fluorides, and to separate (i) unrelated isoparaffin concentrate containing hydrogen fluoride and propane from, (ii) a first motor fuel alkylate stream of reduced organic fluoride content, and containing hydrogen fluoride and normal butane;

b. separating said first alkylate stream, in a second fractionation zone, at a temperature of about 90° F to about 475° F and a pressure of about 120 psig to about 170 psig to decompose additional organic fluorides, and to separate (i) normal butane concentrate containing organic fluorides from hydrogen fluoride (ii) a second motor fuel alkylate stream substantially free from organic fluorides and containing hydrogen fluoride;

c. treating said normal butane concentrate in a first treatment zone having disposed therein a bed of particulate refractory metal oxide comprising bauxite or aluminum at conditions to decompose organic fluorides;

d. said normal butane concentrate from step (c) in a second treatment zone having disposed therei an alkali metal hydroxide at conditions selected to remove hydrogen fluoride and to produce a substantially fluoride-free normal butane;

e. treating said second alkylate stream in a third treatment zone having diposed therein an alkali metal hydroxide at conditions selected to remove hydrogen fluoride and to produce a third motor fuel alkylate stream substantially fluoride-free; and, f. admixing at least a portion of said fluoride-free normal butane with said third alkylate stream to adjust its vapor pressure said predetermined vapor pressure.

2. The method of claim 1 further characterized in that said refractory metal oxide comprises alumina.

3. The method of claim 1 further characterized in that said refractory metal oxide is bauxite.

4. The method of claim 9 further characterized in that said alkali metal hydroxide is potassium hydroxide.

5. The method of claim 1 further characterized in that said feed stream contains isoparaffins having from about four to about seven carbon atoms per molecule.

6. The method of claim 1 further characterized in that said feed stream contains olefins having from about three to about seven carbon atoms per molecule.

7. The method of claim 5 further characterized in that said insoparaffins comprise isobutane.

8. The method of claim 6 further characterized in that said olefins comprise a mixture of propylene and butylene.

* * * * *